US005099786A

United States Patent [19]

Shibata et al.

[11] Patent Number: 5,099,786

[45] Date of Patent: Mar. 31, 1992

[54] APPLICATION DEVICE

[75] Inventors: Norio Shibata; Yasuhito Hiraki; Tsunehiko Sato, all of Kanagawa, Japan

[73] Assignee: Fuji Photo Film Co., Ltd., Kanagawa, Japan

[21] Appl. No.: 666,461

[22] Filed: Mar. 5, 1991

Related U.S. Application Data

[63] Continuation of Ser. No. 390,808, Aug. 8, 1989, abandoned.

[30] Foreign Application Priority Data

Aug. 15, 1988 [JP] Japan ..... 63-201996

[51] Int. Cl.[5] ..... B05C 3/18

[52] U.S. Cl. ..... 118/410; 118/419; 118/429

[58] Field of Search ..... 118/410, 411, 419, 429, 118/DIG. 4, 123, 126, 407

[56] References Cited

U.S. PATENT DOCUMENTS

| | | | |
|---|---|---|---|
| 3,596,432 | 8/1971 | Straub et al. | 118/DIG. 4 |
| 4,476,805 | 10/1984 | Higuchi et al. | 118/410 |
| 4,545,321 | 10/1985 | Bassa | 118/410 |
| 4,675,208 | 6/1987 | Kageyama et al. | 118/410 |
| 4,740,391 | 4/1988 | Long | 118/419 |
| 4,867,097 | 9/1989 | Foltz | 118/410 |

FOREIGN PATENT DOCUMENTS

| | | | |
|---|---|---|---|
| 2607555 | 9/1976 | Fed. Rep. of Germany | 118/410 |
| 804731 | 2/1981 | U.S.S.R. | 118/410 |

*Primary Examiner*—James C. Housel
*Attorney, Agent, or Firm*—Sughrue, Mion, Zinn, Macpeak & Seas

[57] ABSTRACT

An application device for applying a coating liquid to a moving web which forms an applied layer of uniform thickness and with smooth surface properties. The sides of a slotted portion of an extrusion-type application head are provided with sloped or stepped portions in regions adjacent liquid-free areas of the web. This prevents scratching of the web and accumulation of extraneous matter at the edge portions of the application head.

3 Claims, 1 Drawing Sheet

APPLICATION DEVICE

This is a continuation of application Ser. No. 07,390,808 filed Aug. 8, 1989, and now abandoned.

BACKGROUND OF THE INVENTION

The present invention relates to an application device for applying a liquid such as a photographic photosensitive liquid, a magnetic liquid or a surface-protective liquid onto a flexible web made of a plastic film, paper, a metal film or the like.

Conventional application devices for applying a liquid to a web include the roller type, the bead type, the slide coating type, and the extrusion type. While the overall width of each of these devices is larger than that of the web, the width of the portion of the web to which the liquid is applied is smaller than the total width of the web. In other words, the liquid is not applied to the two side edge portions of the web. The width of each of these side edge portions is typically several millimeters to ten and several millimeters. If an application head is pushed against the web to apply the liquid to the moving web as in the application device of the extrusion type, both side edge portions of the web contact the application head so that the head scrapes the surfaces of the side edge portions of the web, dislodging chips therefrom. The scraped-off chips of the web tend to cling to the side edges of the liquid-applying portion of the head. Moreover, foreign matter clinging to the surface of the web can be caught by the side edge of the applying portion of the head. Since the scraped-off chips and the foreign matter, which accumulate on the side edges of the liquid-applying portion of the head, push up the side edges of the web, the thickness of the liquid applied to the web becomes nonuniform along the width thereof with the thickness being larger near the side edges of the web than at and near the central portion thereof. This is a significant problem.

In order to solve this problem, an application method and an application device have been proposed as disclosed in the Japanese Unexamined Published Patent Applications Nos. 257268/86 and 257263/86, respectively. In the application method, a solvent is applied to both side edge portions of a web immediately before a liquid is applied to the other portion of the web. In the application device, the portions of the top edge of a doctor part, which are in positions corresponding to those of application width restriction plates, are chamfered.

In the application method disclosed in Japanese Unexamined Published Patent Application No. 257268/86, however, it has been found that the solvent is likely to migrate to the liquid-carrying portion of the web or move around to the reverse side of the web due to disturbances such as waving, meandering or the like of the web during the movement thereof, again making the application of the liquid nonuniform. The width of the applied solvent increases at the back part and doctor part of the top portion of an application head. If the width of the side portions of the web carrying no liquid is decreased or the scraping capacity of the doctor part is increased, it is difficult to adequately control the solvent-wetted width of the web. This is another problem. If the solvent-wetted width of the web becomes greater than a certain value in manufacturing a magnetic recording medium, for example, the magnetic liquid will cling to the conveyance rolls moving the nonmagnetic web, thereby contaminating the web and calendar rolls provided for the surface treatment of the medium and scratching the surface of the medium, resulting in a deterioration in the magnetic recording properties of the tape.

In the application device disclosed in Japanese Unexamined Published Patent Application No. 257263/86, the side portions of the web cannot be prevented from coming into contact with the back part of the top portion of the application head. For that reason, the back part scrapes the web or catches foreign matter. This is again a problem.

SUMMARY OF THE INVENTION

The present invention was made in order to solve the above-mentioned problems. Accordingly, it is an object of the present invention to provide an application device which forms an applied layer having a uniform thickness and good surface properties and which confines the applied liquid to the correct portion of the web surface.

The application device provided in accordance with the present invention applied the liquid to the surface of a continuously moving web as the slotted top of an application head of the device is pushed against the surface of the web. The application device is characterized in that the slotted top of the application head is provided with slopes or steps corresponding to the side edge portions of the web where no liquid is applied and extending at both ends of the head in such outward directions as to define openings between the web and the slopes or steps.

DESCRIPTION OF THE PREFERRED EMBODIMENTS

Preferred embodiments of the present invention are hereafter described in detail with reference to the attached drawings.

Figure 1:
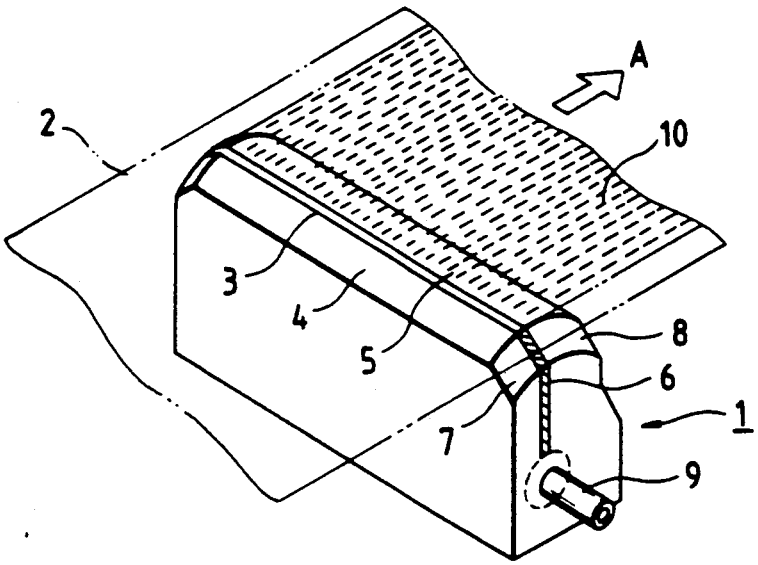
FIG. 1 is a perspective view of an extrusion-type application head of an application device constructed in accordance with a preferred embodiment of the present invention.

FIG. 1 is a perspective view of an extrusion-type application head 1 of an application device constructed in accordance with a preferred embodiment of the invention. The application head 1 is larger in width than a web 2, and has a back part 4 and a doctor part 5 between which is defined a slot 3 through which a liquid to be applied to the web is discharged along the length of the slot extending in the direction of the width of the head. The slot 3 communicates with a liquid reservoir provided in the application head 1 (but not shown in FIG. 1). The liquid supplied through a liquid feed port 9 provided in the liquid reservoir is discharged from the slot 3 under a uniform pressure throughout the length of the slot. Restriction plates 6 are fitted in the body of the application head 1 at both ends of the slot 3 so as to set the application width at which the liquid is discharged from the slot such that the liquid is not applied to the two side edge portions of the web 2. The back part 4 and the doctor part 5 are provided with slopes 7 and 8 at both ends of the back and the doctor parts. The slopes 7 and 8 correspond to both the liquid-free side edge portions of the web 2, and extend down in oblique directions away from the web. As a result, wedge-shaped openings are defined between the web 2 and the slopes 7 and 8 of the application head 1 when the top of the head is pushed against the surface of the moving web to apply the liquid thereto. For this reason, the liquid-free side edge portions of the web 2 do not come into contact with the back part 4 and doctor part 5 of the application head 1. Hence, the liquid-free side edge portions of the web 2 are prevented from being scraped by the back part 4 and the doctor part 5 and foreign matter clinging to the web is prevented from being caught by the ends of the back and doctor parts. Therefore, accumulation of foreign matter is prevented at the ends of the application head 1. As explained above, should this occur the ends of the web 2 would be pushed up, making the thickness of the applied liquid on the web nonuniform along the width thereof. Such action though is prevented with the invention.

Figure 2:
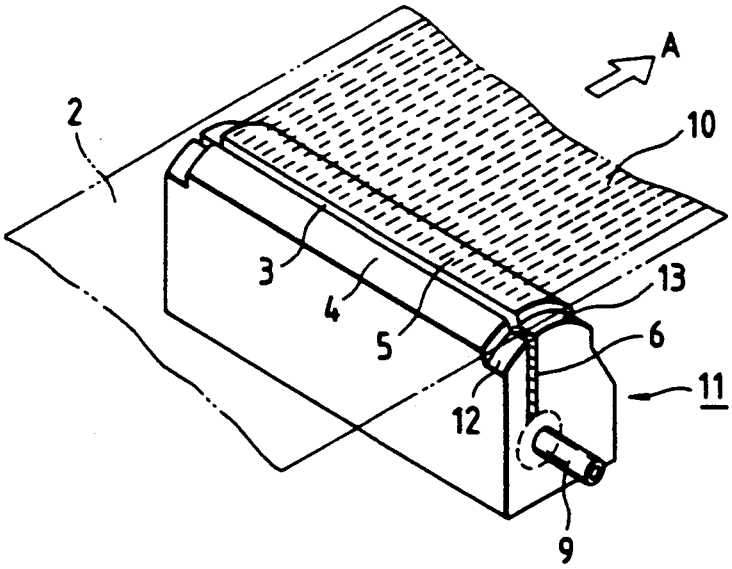
FIG. 2 is a perspective view of an extrusion-type application head of an application device of another embodiment of the present invention.

FIG. 2 is a perspective view of an extrusion-type application head 11 of an application device constructed according to another embodiment of the invention. The application head 11 has a back part 4, a doctor part 5, restriction plates 6, etc., similar to the preceding embodiment. The back part 4 and the doctor part 5 are provided with steps 12 and 13 at both ends of the back and the doctor parts so that openings are defined between the web 2 and the steps. The steps 12 and 13 correspond to both the liquid-free side edge portions of the web 2. Since the two liquid-free side edge portions of the web 2 do not come into contact with the back part 4 and the doctor part 5 of the application head 11, the same as in the preceding embodiment, the thickness of the liquid applied to the web is prevented from being made nonuniform along the width thereof.

The slopes 7 and 8 and the steps 12 and 13 may have various forms without departing from the spirit or essential character of the present invention.

Although the above-described embodiments are in the form of application devices of the extrusion type, the present invention may be embodied as application devices of other types in which the slotted top of an application head is pushed against a continuously moving web to apply a liquid thereto.

In an application device constructed in accordance with the present invention, an application head is provided with slopes or steps corresponding to the two liquid-free side edge portions of a web and extending at the ends of the application head in outward directions so as to define openings between the web and the slopes or steps. Openings are thus defined between the surfaces of the liquid-free side edge portions of the web and the ends of the top of the application head. For this reason, the liquid-free side edge portions of the web are prevented from being scraped by the top of the application head and foreign matter is prevented from clinging to the web and being caught by the end of the application head. As a result, accumulation of foreign matter is prevented at the ends of the application head, thereby eliminating the pushing up of the ends of the web to make the thickness of the applied liquid nonuniform along the width of the web, as occurred in the conventional devices. Therefore, the application device of the invention provides an applied layer having a uniform thickness and good surface properties and prevents the liquid from migrating to undesired areas.

The effects of the present invention will be clarified by describing examples and comparative examples thereof.

EXAMPLE 1

A magnetic liquid, having a composition as shown in Table 1 below, was subjected to mixing and dispersion in a ball mill for ten and a half hours. The viscosity of the magnetic liquid, which was then measured by a viscometer of the ring cone type, was 1.9 poise at a shearing velocity of 700 per second. An application device constructed as shown in FIG. 1 was used to apply the magnetic liquid to a moving web made of polyethylene terephthalate having a thickness of 37 μm and a width of 500 mm. The angle between each of the slopes at both ends of the extrusion-type application head of the device and the horizontal plane was 5°. The quantity of the applied magnetic liquid, the speed of application, the tension of the liquid-carrying portion of the web, and the width of the portion were 17 cc/m², 200 m/min, 10 kg per 500 mm width, and 490 mm, respectively.

A magnetic recording medium 6,000 m in length was manufactured from the coated web. The recording medium was inspected to determine whether the liquid-free side edge portions of the web were scraped by the application head and by what percentage the thickness of each side edge portion of the applied layer of the medium was larger than the average thickness of the layer. The results of the inspection are shown in Table 2 below.

TABLE 1

| Composition: | |
|---|---|
| c-$Fe_2O_3$ (average major grain diameter of 0.5 μm and Hc of 320 Oe) | 300 parts by weight |
| Copolymer of vinyl chloride and vinyl acetate (copolymerization ratio of 87:13 and polymerization degree of 450) | 40 parts by weight |
| Electroconductive carbon | 20 parts by weight |
| Stearic acid | 7 parts by weight |
| Silicone coil | 3 parts by weight |
| Solvent | |
| Xylol | 300 parts by weight |
| Methyl isobutyl ketone | 400 parts by weight |

EXAMPLE 2

An application device as shown in FIG. 2 was used to manufacture a magnetic recording medium 6,000 m in length under the same application conditions as in Example 1. The difference between the height of the back and the doctor parts 4 and 5 of the application head 11 and that of the steps 12 and 13 thereof was 0.05 mm. The manufactured medium was inspected to determine whether the liquid-free side edge portions of the web of the medium were scraped by the application head and by what percentage the thickness of each side edge portion of the applied layer of the medium was larger than the average thickness of the layer. The results of the inspection are shown in Table 2.

COMPARATIVE EXAMPLE 1

An application device as disclosed in Japanese Unexamined Published Patent Application No. 84771/82 and having an extrusion-type application head was used to manufacture a magnetic recording medium of 6,000 m length under the same application conditions as in Example 1. The manufactured medium was inspected to determine whether the liquid-free side edge portions of the web of the medium were scraped by the application head and by what percentage the thickness of each side edge portion of the applied layer of the medium was larger than the average thickness of the layer. The results of the inspection are shown in Table 2.

COMPARATIVE EXAMPLE 2

The application device disclosed in Japanese Unexamined Published Patent Application No. 257263/86 and having an extrusion-type application head, the top edge of the doctor part of which is chamfered, was used to manufacture a magnetic recording medium of length 6,000 m under the same application conditions as in Example 1. The manufactured medium was inspected to determine whether the liquid-free side edge portions of the web of the medium were scraped by the application head and by what percentage the thickness of each side edge portion of the applied layer of the medium was larger than the average thickness of the layer. The results of the inspection are shown in Table 2.

TABLE 2

| | Whether scraped or not | Percentage of increase in thickness |
|---|---|---|
| Example 1 | ○ | 0% |
| Example 2 | ○ | 0% |
| Comparative example 1 | X | 14% |
| Comparative example 2 | Δ | 6% |

In Table 2, the symbol O means that the surface of each U side edge portion of the applied layer was not scratched or scraped and was therefore good, the symbol Δ means that the surface was scratched and therefore slightly damaged, and the symbol X means that the surface was scraped into a powder and therefore considerably damaged.

It is understood from Table 2 that Examples 1 and 2 of the present invention were improved in comparison with Comparative Examples 1 and 2 as to the scraping of the liquidfree side edge portions of the web and the thickness of the side edge portions of the applied layer of the magnetic recording medium.

What is claimed is:

1. In an application device for applying a liquid to a surface of a moving web comprising an application head disposed below said web and pushed against said web, said application head having a rear portion and a doctor portion with a slot being formed between said rear portion and said doctor portion for application of said liquid to said web, said slot directing a flow of said liquid therethrough upward to said web, the improvement wherein said slot has a length less than a width of said web so as to leave liquid-free edge portions on said web, and both side portions of said rear portion and said doctor portion of said application head at ends of said slot have outwardly extending slopes below said web in regions corresponding to said liquid-free edge portions of said web outward of respective ends of said slot, said slopes extending to and being contiguous with respective ends of said slot through which said liquid is applied.

2. The application device of claim 1, wherein said slopes form an angle of substantially 5° with respect to a plane parallel to said slot.

3. The application head device of claim 1, wherein said slot extends into said slopes, and further comprising restriction plates filling portions of said slot extending into said slopes to thereby define an application width of said liquid.

* * * * *